United States Patent [19]

Spitzer et al.

[11] 4,230,243

[45] Oct. 28, 1980

[54] AEROSOL CONTAINER WITH FLAMELESS DELIVERY VALVE

[76] Inventors: Joseph G. Spitzer, 44 Coconut Row, Palm Beach, Fla. 33480; Lloyd I. Osipow, 2 Fifth Ave., New York, N.Y. 10003; Marvin Small, 1100 Park Ave., New York, N.Y. 10021; Dorothea C. Marra, 107 Fernwood Rd., Summit, N.J. 07901

[21] Appl. No.: 932,067

[22] Filed: Aug. 8, 1978

Related U.S. Application Data

[63] Continuation-in-part of Ser. No. 754,471, Dec. 27, 1976, Pat. No. 4,124,149.

[51] Int. Cl.[3] ..... B65D 83/14

[52] U.S. Cl. ..... 222/402.18; 222/547; 239/573

[58] Field of Search ..... 239/573; 222/136, 402.18, 222/402.24, 402.1, 94, 95, 547, 564

[56] References Cited

U.S. PATENT DOCUMENTS 3,069,098 12/1962 Frangos et al. ..... 222/402.18 X 3,854,636 12/1974 Conway et al. ..... 222/402.24

FOREIGN PATENT DOCUMENTS 747379 4/1956 United Kingdom ..... 222/402.18

*Primary Examiner*—David A. Scherbel

[57] ABSTRACT

The invention provides a process and apparatus for delivering from a delivery port of an aerosol container having a vapor tap valve a spray of low flammability of a liquid aerosol composition containing a flammable liquefied propellant, which comprises mixing together liquid aerosol composition and gaseous propellant; subjecting the gas/liquid mixture to the constraint imposed by a flow constriction; expanding the gas/liquid mixture; subjecting the gas/liquid mixture to the constraint imposed by a second flow constriction, and again expanding the gas/liquid mixture and then passing the mixture through the remainder of the vapor tap valve to the delivery port; with each constraint and expansion increasing the gas:liquid volume ratio of the mixture and reducing the flammability of the mixture as a delivered spray.

23 Claims, 6 Drawing Figures

AEROSOL CONTAINER WITH FLAMELESS DELIVERY VALVE

This application is a continuation-in-part of Ser. No. 754,471, filed Dec. 27, 1976, now U.S. Pat. No. 4,124,149, patented Nov. 7, 1978.

Aerosol sprays are now widely used, particularly in the cosmetic, topical pharmaceutical and detergent fields, for delivery of an additive such as cosmetic, pharmacetical, or cleaning composition to a substrate such as the skin or other surface to be treated. Aerosol compositions are widely used as antiperspirants, deodorants, and hair sprays to direct the products to the skin or hair in the form of a finely-divided spray.

Much effort has been directed to the design of valves and valve delivery ports, nozzles, or orifices or orifices which are capable of delivering finely-divided sprays, of which U.S. Pat. Nos. 3,083,917 and 3,083,918 patented Apr. 2, 1963, to Abplanalp et al, and No. 3,544,258, dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator or button of the mechanical breakup type. Such valves provide a soft spray with a swirling motion. Another design of valves of this type is described in U.S. Pat. No. 2,767,023. Valves with vapor taps are generally used where the spray is to be applied directly to the skin, since the spray is less cold.

Marsh U.S. Pat. No. 3,148,127 patented Sept. 8, 1964 describes a pressurized self-dispensing package of ingredients for use as a hair spray and comprising isobutane or similar propellant in one phase and an aqueous phase including the hair setting ingredient. The isobutane is in a relatively high proportion to the aqueous phase, and is exhausted slightly before the water phase has been entirely dispensed. A vapor tap type of valve is used having a 0.030 inch vapor tap orifice, a 0.030 inch liquid tap orifice, and a 0.018 inch valve stem orifice, with a mechanical breakup button. There is no disclosure of the relative proportions of propellant gas to liquid phase being dispensed.

Rabussier U.S. Pat. No. 3,260,421 patented July 12, 1966 describes an aerosol container for expelling an aqueous phase and a propellant phase, fitted with a vapor tap valve, and capillary dip tube. To achieve better blending of the phases before expulsion, the capillary dip tube is provided with a plurality of perforations 0.01 to 1.2 mm in diameter over its entire length, so that the two phases are admitted together in the valve chamber from the capillary dip tube, instead of the gas being admitted only through a vapor tap orifice, and the liquid through a dip tube as is normal. The propellant is blended in the liquid phase in an indeterminate volume in proportion to the aqueous phase in the capillary dip tube.

Presant et al in U.S. Pat. No. 3,544,258, referred to above, discloses a vapor tap valve having a stem orifice 0.018 inch in diameter, a vapor tap 0.023 inch in diameter with a capillary dip tube 0.050 inch in diameter. The button orifice diameter is 0.016 inch. The composition dispensed is an aluminum antiperspirant comprising aluminum chlorhydroxide, water, alcohol and dimethyl ether. The aluminum chlorhydroxide is in solution in the water, and there is therefore only one liquid phase. The dimensions of the orifices provided for this composition are too small to avoid clogging, in dispensing an aluminum antiperspirant composition containing dispersed astringent salt particles.

The vapor tap type of valve is effective in providing fine sprays. However, it requires a high proportion of propellant, relative to the amount of active ingredients dispensed per unit time. A vapor tap requires a large amount of propellant gas, because the tap introduces more propellant gas into each squirt of liquid. Such valves therefore require aerosol compositions having a rather high proportion of propellant. A high propellant proportion is undesirable, however. The fluorocarbon propellants are thought to be deleterious, in that they are believed to accumulate in the stratosphere, where they may possibly interfere with the protective ozone layer thereof. The hydrocarbon propellants are flammable, and their proportion must be restricted to avoid a flame hazard. Moreover, both these types of propellants, and especially the fluorocarbons, have become rather expensive.

Another problem with such valves is that since they deliver a liquid propellant-aerosol composition mixture, and have valve passages in which a residue of liquid remains following the squirt, evaporation of the liquid in the valve passages after the squirt may lead to deposition of solid materials upon evaporation of liquids, and valve clogging. This problem has given rise to a number of expedients, to prevent the deposition of solid materials in a form which can result in clogging.

Consequently, it has long been the practice to employ large amounts of liquefied propellant, say 50% by weight or more, to obtain the droplets of liquid sprays or fine powder sprays, and a rather small solids content, certainly less than 10%, and normally less than 5%. The fine sprays result from the violent boiling of the liquefied propellant after it has left the container. A case in point is exemplified by the dispersion-type aerosol antiperspirants, which contain 5% or less of astringent powder dispersed in liquefied propellant. It has not been possible to use substantially higher concentrations of astringents without encountering severe clogging problems.

There is considerable current interest in the substitution of compressed gases for fluorocarbons and hydrocarbons as propellants to obtain fine aerosol sprays. The reasons include the low cost of compressed gases, the flammability of liquefied hydrocarbon propellants, and the theorized hazard to the ozone layer of liquefied fluorocarbon propellants. Reasonably fine sprays of alcoholic solutions have been obtained using carbon dioxide at 90 psig and valving systems with very fine orifices. These orifices are so small that dispersed solids cannot be tolerated, and even inadvertent contamination with dust will cause clogging. Thus, a typical system will employ a 0.014 inch capillary dip tube, a 0.010 inch valve stem orifice, and a 0.008 inch orifice in a mechanical break-up actuator button. However, only limited variations in delivery rates are possible, since the use of significantly larger orifices will coarsen the spray droplets. Moreover, these fine sprays of alcoholic solutions are flammable.

Thus far, the art has not succeeded in obtaining fine aerosol sprays using aqueous solutions with compressed gases. The reasons for this are that water has a higher surface tension than alcohol (ethanol or isopropanol) and is also a poorer solvent for the compressed gases, particularly carbon dioxide, which is preferred. All of these factors adversely affect the break-up of droplets to form a fine spray.

Special designs of the delivery port and valve passages have been proposed, to prevent the deposit of solid materials in a manner such that clogging can result. U.S. Pat. No. 3,544,258 provides a structure which is especially designed to avoid this difficulty, for example. Such designs result however in a container and valve system which is rather expensive to produce, complicated to assemble because of the numerous parts, and more prone to failure because of its complexity.

In accordance with Spitzer et al U.S. Pat. No. 3,970,219, patented July 20, 1976, aerosol containers are provided that are capable of delivering a foamed aerosol composition. The aerosol composition is foamed inside the aerosol container, and delivered through the valve of the aerosol container as a foam or collapsed foam. Fine droplets are formed from the foamed aerosol compositions, due at least in part to collapse of thin foam walls into fine droplets. The propellant serves to foam the liquid within the container, forming a foamed aerosol composition, and propels from the container through the valve and delivery port both any foam and any droplets that form when the foam collapses.

With conventional aerosol containers, a substantial proportion of the propellant is in liquid form as the aerosol composition passes through the valve and delivery port. Propellant evaporates as the spray travels through the air, and it continues to evaporate after the spray has landed on a surface. The heat of vaporization is taken from the surface, and the spray consequently feels cold. This is wasteful of propellant, as is readily evidenced by the coldness of sprays from conventional aerosol containers. In contrast, in the invention of U.S. Pat. No. 3,970,219, the propellant is in gaseous form when expelled with the liquid. The propellant is not wasted, therefore, and since there is substantially no liquid propellant to take up heat upon vaporization, the spray is not cold.

The aerosol containers in accordance with the invention of U.S. Pat. No. 3,970,219 accordingly foam an aerosol composition therein prior to expulsion from the container, and then expel the resulting foamed aerosol composition. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position, for expulsion of aerosol composition foamed within the container via the valve passage and delivery port; means defining at least two separate compartments in the container, of which a first compartment is in direct flow connection with the valve passage, and a second compartment is in flow connection with the valve passage only via the first compartment; and porous bubbler means having through pores interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve.

Spitzer et al U.S. Pat. No. 4,019,657, patented Apr. 26, 1977, provides another form of foam-type aerosol container, in which the aerosol composition therein is foamed prior to expulsion from the container, and then the resulting foamed aerosol composition is expelled. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position for expulsion via the valve passage and delivery port of aerosol composition foamed within the container; means defining at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to 0.2 cm and communicating the first and another compartment for flow of liquid aerosol composition into the first compartment, and of sufficiently small dimensions to restrict flow of liquid aerosol composition therethrough; the ratio of first compartment volume/first orifice diameter being from about 10 and preferably from about (20/x) to about (400/x) and preferably about (200/x) where x is 1 when the orifice length is less than 1 cm, and 2 when the orifice length is b 1 cm or more; at least one second gas tap orifice having a total cross-sectional open area within the range from about $7\times10^{-6}$ to about $20\times10^{-4}$ in$^2$ ($4\times10^{-5}$ to $1.3\times10^{-2}$cm$^2$), a single orifice having a diameter within the range from about0.003 to about 0.05 inch (0.007 to 0.13 cm) and communicating the first and second compartments for flow to propellant gas into the first compartment from the second compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel the foamed aerosol composition through the open valve.

The advantages of foaming the aerosol composition within the container are twofold. Because the propellant is in gaseous form (having been converted to gas in the foaming) there is no liquid propellant to expel, so all propellant is usefully converted into gas, for propulsion and foaming, before being expelled. Because the foamed liquid aerosol composition has a higher volume than the liquid composition, and the expulsion rate is in terms of volume per unit time, less liquid is expelled per unit time. Thus, in effect, the liquid is expelled at a lower delivery rate, which conserves propellant per unit squirt, and means a higher active concentration must be used, to obtain an equivalent delivery rate of active ingredient. Also, since there is less liquid, there is a negligible clogging problem, even at a two or three times higher active concentration.

The disadvantage of foaming however is the need to provide space for the foaming to take place, which requires either a larger container or a smaller unit volume of composition per container.

U.S. Pat. application Ser. No. 757,414, filed Jan. 6, 1977 shows that a low delivery rate can be achieved without the necessity of providing a foam chamber or space within the aerosol container, if the volume proportion of gas to liquid in the blend, as blended and then dispensed from the container, is within the range from about 10:1 to about 40:1, and preferably within the range from about 15:1 to about 30:1. This is a sufficient proportion of gas to liquid to form a foam, such as is formed and dispensed from the foam type aerosol containers of U.S. Pat. No. 3,970,219 and referred to above, and a very much higher proportion of gas to liquid than has previously been blended with the liquid for expulsion purposes in conventional aerosol containers, such as the vapor tap containers of the Presant U.S. Pat. No. 3,544,258, referred to above. At such high proportions of gas to liquid, the formation of foam is possible, and even probable, despite the small volume of the blending space provided, but foam formation, if it occurs, is so fleeting, having a life of at most a fraction of a second, that a foam cannot be detected by ordinary means, due to the small dimensions of the open spaces in which it may exist, i.e., the blending space and valve passages, and the shortness of the delivery time from blending of gas and liqud to expulsion. However, the weight proportion of gas to liquid in the blend that is expelled can be determined and when the volume proportion calculated at 21° C. and the pressure of the liquefied propellant is in excess of 10:1, the delivery rate of liquid from the aerosol container is very low, and thus, the objective of the invention is achieved. Whether or not a foam is formed is therefore of no significance, except as a possible theoretical explanation of the phenomenon.

Accordingly, Ser. No. 757,414 provides a process for dispensing a spray containing a low proportion of liquid, with a high proportion of propellant in gaseous form, by blending gas and liquid within the aerosol container prior to expulsion at a ratio of gas:liquid within the range from about 10:1 to about 40:1, and preferably from about 15:1 to about 30:1, with the result that a blend containing this low proportion of liquid and high proportion of gas is expelled from the container, and the proportion of liquid composition expelled per unit time correspondingly reduced.

The aerosol container in accordance with Ser. No. 757,414 comprises, in combination, a pressurizable container having a valve movable between open and closed positions, a valve stem, and a delivery port; a valve stem orifice in the valve stem in flow connection at one end with a blending space and at the other end with an aerosol-conveying valve stem passage leading to the delivery port; the valve stem orifice having a diameter within the range from about 0.50 to about 0.65 mm; bias means for holding the valve in a closed position; means for manipulating the valve against the bias means to an open position for expulsion of aerosol composition via the valve stem orifice to the delivery port; wall means defining the blending space and separating the blending space from liquid aerosol composition and propellant within the container; at least one liquid tap orifice through the wall means, having a cross-sectional open area within the range from about 0.4 and 0.6 $mm^2$ for flow of liquid aerosol composition into the blending space; at least one vapor tap orifice through the wall means, having a cross-sectional open area within the range from about 0.4 to about 0.8 $mm^2$ for flow of propellant into the blending space; the ratio of liquid tap orifice to vapor tap orifice cross-sectional open area being within the range from about 0.5 to about 0.9; the open areas of the liquid tap orifice and vapor tap orifice being selected within the stated ranges to provide a volume ratio of propellant gas:liquid aerosol composition within the range from about 10:1 to about 40:1, thereby limiting the delivery rate of liquid aerosol composition from the container when the valve is opened.

The dimensions of such aerosol containers are particularly suited to the dispensing of antiperspirant compositions in which the astringent salt is in dispersed form, where orifices of smaller dimensions are readily susceptible to clogging. Smaller dimensions can be used with compositions in which the active components are in solution, such as deodorants and hair sprays. Volume ratio requirements will vary somewhat, depending on the aerosol composition. In general, the volume ratio of propellant gas:liquid aerosol composition within the range from about 8:1 to about 40:1 is applicable to any aerosol composition containing a flammable propellant. The flammability of the spray is greatly reduced when the container is actuated in its normal, vertical position. At a higher than about 40:1 ratio, the propellant is exhausted too rapidly, and an excessive amount of non-propellant compositions remains in the container.

The aerosol containers in accordance with Ser. No. 757,414 have provision for expelling these high ratios of gas:liquid when the container is actuated in a normal or partially tilted position. However, if the container is inclined or tipped enough, or inverted, so that the gas phase can pass through the liquid tap orifice, and the liquid phase can pass through the vapor tap orifice, the gas:liquid ratio expelled is less than about 8:1, and flammability is accordingly increased.

At some angle of tilt as the container is tipped from an upright towards a horizontal position, liquid phase can reach and pass through the gas tap orifice, and perhaps even both liquid tap and vapor tap orifices. This can result in an extremely flammable spray. Whether the latter condition actually occurs depends on the configuration of the container, the bend of the dip tube, and the liquid fill of the container.

Aerosol containers are commonly filled so that the liquid phase occupies 60% of the total capacity at 21° C. With this fill in a container with minimum doming, a straight dip tube, and a vapor tap orifice about 0.6 mm in diameter, off-center and positioned downward when the container is horizontal, both gas and liquid tap orifices will be covered by liquid when the container is positioned so that the valve is in the range of about −5° (below horizontal) to +5° (above horizontal). If the dip tube blends downward when the container is horizontal, the range in valve position in which both taps are covered by liquid may extend to about −30° (below the horizontal) to about +5° (above the horizontal). The extent or span of this range will depend on the dimensions of the container. The larger the ratio of diameter:-height, the wider the span of the range.

The problem also arises in the foam-type aerosol containers of U.S. Pat. No. 4,019,657. At any angle where the valve is below the horizontal, the foam chamber can fill with the liquid phase, and the gas phase under high pressure will project this liquid from the container, when the delivery valve is opened.

With the aerosol containers of U.S. Pat. No. 3,970,219, the problem of a flammable spray due to the presence of a flammable liquefied propellant does not exist. Since the propellant is expelled only in gaseous form, very little liquid propellant need be present, and it will not cover the bubbler in any position. A flammability problem will arise only in the event that the liquid in the foam chamber is flammable. Then, if the foam chamber is more than 50% full, at any angle between the horizontal to an inverted orientation, the liquid will be expelled without benefit of foaming, and the spray will be flammable.

This problem is not normally encountered if the aerosol composition contains a preponderance of the nonflammable fluorocarbon propellants, unless the composition contains a high proportion of alcohol, such as hair sprays, when actuated in the normal upright position. If, however, nonflammable fluorocarbons cannot be used, and it is necessary to employ flammable hydrocarbon propellants, at least in a proportion where the liquid phase is flammable, then aerosol containers equipped with conventional vapor tap valves will pose a considerable fire hazard even when used in the normal, upright position. This hazard is posed by the containers of U.S. Pat. Nos. 3,970,219 and 4,019,657 and Ser. No. 757,414, only when the delivery valves of such containers are actuated with the container in an abnormal position ranging between below the horizontal to fully inverted.

In accordance with Ser. No. 754,471, filed Dec. 27, 1976, now U.S. Pat. No. 4,124,149, patented Nov. 7, 1978, this difficulty is overcome by including in combination with the delivery valve an overriding shut-off valve which, although normally open when the container is upright, automatically closes off flow of liquid through the delivery valve from the container to the delivery port at some limiting angle at or below the horizontal as the top of the container is brought below the horizontal, towards the fully inverted position. The shut-off valve will normally have closed fully before the container is fully inverted. The angle to the horizontal at which the valve must close is of course the angle at which liquid can flow to the delivery port and escape as liquid from the container, without benefit of a high gas ratio. This can be within the range from 0° (i.e., horizontal) to −90°, and preferably is from −5° to −45°, below the horizontal.

In this type of container, it is generally not possible to dispense the liquid contents of the container by opening the delivery valve unless the container is so oriented that a sufficient ratio of gas is expelled with the liquid phase. The container must be held in a fully upright position, or at least in a position with the valve above the horizontal. Otherwise, the liquid phase cannot flow through the open delivery valve, because the shut-off valve is closed.

The aerosol container in accordance with Ser. No. 754,471 comprises, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

A preferred embodiment of delivery valve is of the vapor tap type, comprising a valve movable manually between open and closed positions; a valve stem and a delivery port; a valve stem orifice in the valve stem, in flow connection at one end with a blending space, and at the other end with an aerosol-conveying valve stem passage leading to the delivery port; bias means for holding the delivery valve in a closed position; means for manipulating the valve against the bias means to an open position, for expulsion of aerosol composition via the valve stem orifice to the delivery port; wall means defining a blending space, and separating the blending space from liquid aerosol composition and propellant within the container; at least one liquid tap orifice through the wall means; at least one vapor tap orifice through the wall means; and a shut-off valve means movable between a closed position closing off the valve stem passage and an open position allowing aerosol composition to pass through the valve stem passage, the shut-off valve being in the open position at least when the container is fully upright, and being in the closed position at least when the container is fully inverted, and moving from the open to the closed position at an angle therebetween beyond the horizontal at which liquid propellant can flow to and through the vapor tap orifice and escape through the delivery port via the aerosol conveying valve stem passage when the delivery valve is in the open position.

The use of a ball valve requires an appreciable increase in the size of the delivery valve structure, to accommodate the ball and travel space for rolling of the ball between open and closed positions. The generally small size of aerosol valve systems requires rather precise size tolerances, particularly to avoid hang-up of the ball under the high fluid pressures in aerosol containers.

In accordance with the present invention, an aerosol container is provided, especially intended for use with compositions containing liquefied flammable propellants, and having a delivery valve that delivers a spray that is either flameless or at worst has an abnormally low flame extension, whether the container is in an upright position or in a fully inverted position, comprising, in combination, a pressurizable container having at least one storage compartment for a liquefied aerosol composition and a liquefied propellant; a delivery valve movable manually between open and closed positions, and including a valve stem, a valve stem passage, a valve stem orifice at the beginning of the valve stem passage, and a delivery port; a mixing chamber having at least one liquid tap and at least one vapor tap orifice in flow connection with the storage compartment for reception therefrom and mixing together in the chamber liquid aerosol composition and gaseous propellant, respectively; an aerosol-conveying passage in flow connection at one end with the mixing chamber and at the other end with the valve stem orifice, manipulation of the delivery valve opening and closing the passage to flow of aerosol composition and propellant from the storage compartment to the mixing chamber and delivery port; and at least two flow constrictions disposed across the passage in the line of flow from the mixing chamber to the valve stem orifice, each constriction having an open area within the range from about 0.05 to about 0.4 $mm^2$, and at least two expansion chambers, one following each constriction, each having an open area at least 25% greater than that of the preceding constriction, thereby increasing the gas:liquid volume ratio in the mixture leaving the delivery port and reducing the flammability of the delivered spray.

The flow constriction can take the form of an orifice, a passage, or a venturi.

Preferably, each flow constriction has a sharp edge that faces the oncoming flow through the aerosol-conveying passage from the mixing chamber. Accordingly, the term "sharp-edged constriction" as used herein refers to a constriction having such an upstream face.

The requirement for at least two flow constrictions is based on the following observations:

With only a single flow constriction, a spray of low flammability can be obtained with the container in the upright position by increasing the size of the vapor tap orifice relative to that of the liquid tap orifice leading into the mixing chamber. However, with the container in the inverted position, a spray of high flammability is produced. Conversely, reducing the size of the vapor tap orifice relative to that of the liquid tap orifice will give a spray of low flammability with the container in the inverted position and a spray of high flammability with the container in the upright position. It is not possible by adjustment of the size of vapor tap and liquid tap orifices to obtain a spray of low flammability in both the upright and inverted positions of the container.

With two or more flow constrictions, sprays of low flammability can be obtained with the container in the upright position and in the inverted position, and by adjustment of the flow constriction open areas, sprays with zero flame extension can be obtained in both positions of the container.

If the container has only one flow constriction, in order to obtain a spray of low flammability it is necessary to have a large vapor tap orifice relative to the liquid tap orifice, to obtain a high volume ratio of gas to liquid in the spray. It is believed that the liquid droplets in the spray are then well separated by propellant gas, and a lower flammability results.

Two or more flow constrictions appear to reduce the gas:liquid weight ratio of the gas/liquid mixture passing through them. Further, since a smaller ratio of the open area of the vapor tap orifice:liquid tap orifice is actually required to obtain a spray of reduced flammability, a lower weight proportion of gas:liquid is introduced into the mixing chamber.

It is believed that the reason for this effect is the difference in flow characteristics of a gas and a liquid through a flow constriction. The gravimetric flow rates of both gas and liquid are restrained by any flow constriction. However, the volumetric flow rate of the liquid is restrained, while the volumetric flow rate of the gas is not affected. The flow constriction results in a pressure drop, and the gas expands as the pressure is reduced.

Of course, the liquid under consideration is not a normal, noncompressible liquid, since it contains liquefied propellant, a portion of which may be converted to propellant gas, as the mixture passes through the flow constriction, due to the drop in pressure. This would further reduce the quantity of liquid flowing. Regardless of the contribution due to volatilization of liquefied propellant, each time the mixture passes through a flow constriction, the volume ratio of gas:liquid increases; on the downstream side of the constriction, the ratio is higher than on the upstream side.

This effect makes it possible to provide the mixing chamber with a vapor tap orifice and a liquid tap orifice of normal size, even in a size range which normally provides a proportion of gas and liquid that gives a flammable spray, when a flammable propellant such as a liquefied hydrocarbon is present. The two flow constrictions, each of which is followed by an expansion chamber downstream, ensure a sufficiently higher gas:liquid volume ratio, but at a reduced pressure, by the time the mixture is delivered at the delivery port that the spray is of reduced flammability, and may even be flameless under the conditions of the standardized flame extension test. Such sprays give a flame projection of below from six to eight inches, in the normal case.

Accordingly, the invention provides a process for delivering from a delivery port of an aerosol container having a vapor tap valve a spray of low flammability of a liquid aerosol composition containing a flammable liquefied propellant, which comprises mixing together liquid aerosol composition and a gaseous propellant; subjecting the gas/liquid mixture to the constraint imposed by a flow constriction; expanding the gas/liquid mixture; subjecting the gas/liquid mixture to the constraint imposed by a second flow constriction, and again expanding the gas/liquid mixture and then passing the mixture through the remainder of the vapor tap valve to the delivery port; with each constraint and expansion increasing the gas:liquid volume ratio of the mixture, reducing the pressure, and reducing the flammability of the mixture as a delivered spray.

It is preferred that the flow constriction have a sharp edge at the upstream side thereof. In the presence of the sharp edge, the constraint is more intense, the gas:liquid volume ratio may increase further, and the spray delivered at the delivery port will be of lower flammability.

The length and configuration of the flow constriction are not however critical. The constriction can have any polygonal shape in cross-section such as square, rectangular, hexagonal and triangular, as well as round or elliptical. It can be of uniform diameter from end to end, or tapered, i.e., a venturi, or tapered in either direction only.

The constriction can be quite short. Thus a length within the range from about 0.01 mm to about 15 mm gives excellent results. An orifice is adequate. A short capillary passage is also effective. Because of space considerations, there is no need, therefore, to provide an elongated passage longer than 10 mm, since this will simply extend the overall length of the delivery valve structure, without any compensating effect in reducing flammability of the resulting spray.

The volume of liquid discharged per unit time after flow through a sharp-edged orifice is given by the following equation:

$$Q_L = C\,a\,V_L$$

where $Q_L$ is the volume of liquid discharged per unit time;

C is the coefficient of discharge;

a is the area of the orifice; and $V_L$ is the linear flow rate.

The coefficient of discharge is equal to the product of the coefficient of contraction and the coefficient of friction, and is given by the equation:

$C = C_c \times C_f$

In the course of passage through a sharp edged orifice, a liquid will be compressed or contracted until it reaches the portion of smallest diameter of the orifice, the vena contracta. The coefficient of contraction of most liquids in turbulent flow is within the range from 0.61 to 0.65. The coefficient of friction under turbulent flow for most liquids is in the range from about 0.95 to about 0.98. The coefficient of discharge is thus about 0.60.

On the other hand, a gas does not contract but expands due to the pressure drop in the course of passage through an orifice. It is thus evident that the flow-through of liquid is considerably more restrained by the orifice than is the flow-through of a gas.

In the case of a short capillary tube or similar constricted passage, the coefficient of discharge of most liquids is within the range from about 0.72 to about 0.83, so that the restraining effect due to the coefficient of discharge of such a passage is somewhat less than that of an orifice.

The relative open areas for flow-through of the flow constriction and the expansion chamber are important in increasing the gas:liquid ratio. The expansion chamber should have an open area at least 25% and preferably at least 50% greater than that of the flow constriction. In general, the effect on discharge coefficient reaches a limiting value at open areas for the expansion chamber exceeding twice that of the flow constriction.

As indicated previously, the mixing chamber includes at least one gas tap orifice and at least one liquid tap orifice in flow communication with the storage compartment for flow thereinto of gaseous propellant and liquid aerosol composition, respectively. These orifices can have the normal dimensions. Downstream of the mixing chamber a conventional vapor tap valve includes a valve stem orifice. This orifice if dimensioned within the limits of the present invention can serve as the last flow constriction, if it is followed by an expansion chamber of the required dimensions, as noted above.

It is then necessary to introduce at least one more flow constriction between the storage compartment and the valve stem orifice, and follow this as well by an expansion chamber of the required dimensions.

Preferably, the vapor tap aerosol delivery valve is fabricated with an extended tail piece, and the first flow constriction is provided in the tail piece, downstream of the mixing chamber. The mixing chamber including the vapor tap and liquid tap orifices then is located in the tail piece extension with the first flow constriction, also.

The second flow constriction can also be located in the tail piece, downstream of the mixing chamber, which is also in the tail piece, as well as the expansion chamber following the first flow constriction, and between the two flow constrictions. The normal mixing chamber in the valve housing can serve as the expansion chamber for the second flow constriction. Then, if desired, the valve stem orifice can serve as a third flow constriction, downstream of the normal mixing chamber.

The actuator or nozzle, which includes the delivery port, ordinarily contains one flow constriction at the delivery port, and may contain two. These do not serve as flow constrictions in accordance with this invention, because they are too far downstream, and do not decrease flammability of the spray.

Hence, the last flow constriction of the invention is the valve stem orifice.

More than two flow constrictions can be provided, each followed by an expansion chamber. The more flow constrictions, the more constraint, and the lower the gas pressure at the delivery port. The more constraint, the lower the delivery flow rate, so one must balance the number of constrictions against the flow rate required. There is normally no reason to use more than four such constrictions followed by four expansion chambers, including the valve stem orifice. From two to four constrictions give adequate results in ensuring a spray of low flammability.

The liquid tap orifice is preferably a capillary dip tube, although a short orifice can also be used in combination with a standard noncapillary dip tube. The capillary dip tube is preferred because when the container is inverted, the vapor tap orifice is submerged in liquid, while the dip tube is initially partially filled with liquid. A dip tube can produce a flash flame extension, which is of shorter duration, the smaller the inside diameter of the dip tube, and can be negligible if the inside diameter of the capillary dip tube is less than about 0.8 mm.

If the flow constrictions are orifices or short capillary passages, there can be one or more liquid tap orifices that are capillary dip tubes providing an aggregate cross-sectional open area within the range from about 0.08 to about 3.0 $mm^2$, one or more vapor tap orifices providing an aggregate cross-sectional open area within the range from about 0.05 to about 0.8 $mm^2$, the ratio of liquid tap orifice to vapor tap orifice cross-sectional open area being within the range of about 1.5:1 to about 4:1, a first flow constriction having a cross-sectional open area within the range from about 0.05 to about 0.4 $mm^2$; a second flow constriction having a cross-sectional open area within the range from about 0.05 to about 0.4 $mm^2$; the open areas of the said liquid tap orifice, vapor tap orifice and flow constrictions being selected within the stated ranges to provide a delivered spray that is either flameless or of reduced flammability of liquid aerosol composition in both an upright and inverted position of the container when the valve is open.

In the preferred embodiment of this type of valve, where the flow constrictions are orifice or short capillary passages, there are one or more liquid tap orifices that are capillary dip tubes providing aggregate cross-sectional open areas within the range from about 0.2 to about 1.2 $mm^2$, one or more vapor tap orifices providing an aggregate cross-sectional open area within the range from about 0.08 to about 0.6 $mm^2$, the ratio of liquid tap orifice to vapor tap orifice cross-sectional open area being within the range from about 1.5:1 to about 4:1, a first constricted passage having a cross-sectional open area within the range from about 0.08 to about 0.3 $mm^2$; a second constricted passage having a cross-sectional open area within the range from about 0.08 to about 0.3 $mm^2$; the open areas of the said liquid tap orifice, vapor tap orifice and constricted passages being selected within the stated ranges to provide at the delivery port a delivered spray of liquid aerosol composition that is either flameless or of reduced flammability in both an upright and inverted position of the container when the valve is open.

The valve delivery system normally includes, in addition to the valve, an actuator at the end of the passage through the valve. The valve delivery system from the mixing chamber through the valve stem and actuator to the delivery port thus includes, in flow sequence towards the delivery end, at least two flow constrictions, of which the last can be the valve stem orifice, followed by an expansion chamber which can be the valve stem passage, and one can be in the valve upstream from the valve stem orifice, followed also by an expansion chamber. One or more nonfunctional flow constrictions are provided by orifices present in the actuator. The actuator orifice at the delivery port should have an open area within the range of about 0.05 to about 0.3 $mm^2$, and preferably from about 0.08 to about 0.2 $mm^2$.

The valve stem orifice to serve as a flow constriction of the invention should have an open area within the range from about 0.05 to about 0.4 $mm^2$, preferably from about 0.08 to about 0.3 $mm^2$. The open area can be larger than about 0.4 $mm^2$, but then it does not serve as one of the flow constrictions of the invention.

The liquid and gas tap orifices are located in the wall of the mixing chamber. The volume of the mixing chamber does not usually exceed 0.5 cc, and can be as small as 0.01 cc, but it is preferably within the range from 0.01 to 0.1 cc.

The orifice ranges given are applicable to solution-type and liquid emulsion- or dispersion-type aerosol compositions. Modified orifice ranges may be required with dispersion-type aerosol compositions where the dispersed material is a finely divided solid, if clogging of flow constrictions is a problem.

Preferred embodiments of aerosol containers and valves in accordance with the invention are illustrated in the drawings, in which:

FIG. 1 represents a fragmentary longitudinal sectional view of the valve system of one embodiment of aerosol container in accordance with the invention, including a vapor tap orifice and capillary dip tube in fluid flow connection with the mixing chamber, which is in the valve tail piece; with the first flow constriction in the tail piece downstream of the mixing chamber, and the second flow constriction the valve stem orifice, with expansion chambers in the valve housing beyond the tail piece and in the valve stem;

In principle, the preferred aerosol containers of the invention utilize a container having at least one compartment for propellant gas and liquid aerosol composition, communicated by at least one gas tap orifice and at least one liquid tap orifice to a mixing chamber, which is across the line of flow to the valve delivery port. Downstream of the mixing chamber, across the line of flow to the valve stem orifice, are at least two flow constrictions and at least two expansion chambers, one downstream of each flow constriction. A liquid aerosol composition to be blended with propellant gas and then expelled from the container is placed in the storage compartment of the container, in flow communication via the liquid tap orifice with the mixing chamber, so as to admit liquid aerosol composition into the mixing chamber, while propellant gas flows into the mixing chamber via the vapor tap orifice or orifices. The gas/-liquid mixture then flows through two or more flow constrictions and expansion chambers through the valve stem orifice to the delivery port, the gas pressure decreasing and the gas volume:liquid volume ratio increasing as it does so, resulting in delivery of a spray having a low flammability.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin, and acetal polymers such as CELCON or DELRIN are suitable container materials.

The gas tap and liquid tap orifices can be disposed in any type of porous or foraminous structure. One each of a gas tap and liquid tap orifice through the compartment wall separating the propellant and any other compartments from the mixing chamber will suffice. A plurality of gas tap and liquid tap orifices can be used, for more rapid blending and composition delivery, but the delivery rate of liquid will still be low, because the sharp-edged constricted passages downstream increase the gas:liquid ratio. The total orifice open area is of course determinative, so that several large orifice can afford a similar delivery rate to many small orifices. However, gas tap orifices size also affects blending, so that a plurality of small gas tap orifices may be preferable to several large orifices.

Orifices may also be provided on a member inserted in the wall or at one end of the wall separating the propellant and any other compartment from the blending space. One type of such member is a perforated or apertured plastic or metal plate or sheet.

Figure 1:
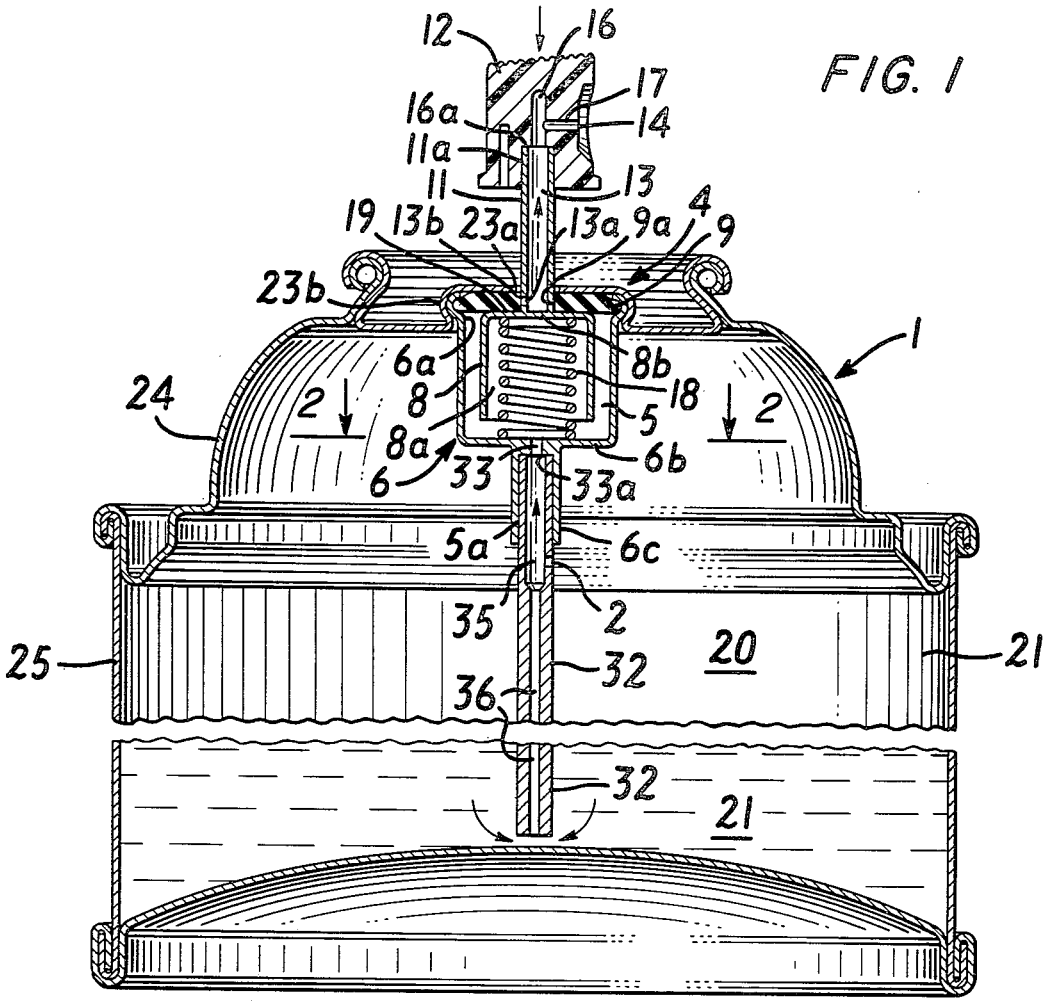
Figure 2:
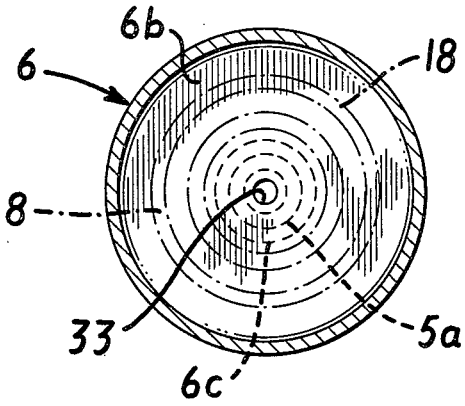
FIG. 2 represents a cross-sectional view taken along the line 2—2 of FIG. 1.

In the aerosol container 1 shown in FIGS. 1 and 2, the aerosol valve 4 is of conventional type, except that the vapor tap orifice is located in the tail piece, which is of sufficient size to receive the capillary dip tube, vapor tap orifice, mixing chamber and flow constriction. It comprises a delivery valve poppet 8 seating against the sealing face 19 of a sealing gasket 9 and integral with a valve stem 11. The delivery valve poppet 8 is open at the inner end, defining a socket **8*a* therein, for the reception of a coil spring 18. The passage 13 is separated from the socket 8*a* within the poppet 8 by the divider wall 8*b***.

Adjacent the poppet wall **8*b* in a side wall of the stem 11 is a valve stem orifice 13*a*, which is a sharp-edged constricted passage and constitutes in this embodiment one of the flow constrictions of the invention. The sharp edge 13*b* at the inlet side of the orifice 13*a* is beneficial in further constraining liquid flow therethrough. The gasket 9 has a central opening 9*a* therethrough, which receives the valve stem 11 in a sliding leak-tight fit, permitting the stem to move easily in either direction through the opening, without leakage of propellant gas or liquid from the container. When the valve stem is in the outwardly extended position shown in FIG. 1, the surface of the poppet portion 8 contiguous with wall 8*b*** is in sealing engagement with the inner face of the gasket 9, closing off the orifice 13*a* and the passage 13 to outward flow of the contents of the container.

The outer end portion 11*a* of the valve stem 11 is received in the axial socket 16 of the button actuator 12, the tip engaging the ledge 16*a* of the recess. The stem is attached to the actuator by a press fit. The axial socket 16 is in flow communication with a lateral passage 17, leading to the actuator (valve delivery) orifice 14 of the button 12.

The compression coil spring 18 has one end retained in the socket 8*a* of the valve poppet 8, and is based at its other end upon inner wall 6*b* of the valve housing 6. The spring 18 biases the poppet 8 towards the gasket 9, engaging it in a leak-tight seal at the valve seat 19. When the valve poppet is against the valve seat 19, the orifice 13*a* leading into the passage 13 of the valve stem is closed off.

The delivery valve is however reciprocably movable towards and away from the valve seat 19 by pressing inwardly on the button actuator 12, thus moving the valve stem 11 and with it poppet 8 against the spring 18. When the valve is moved far enough away from the seat 19, the orifice 13*a* is brought beneath the valve gasket 9, and a flow passage is therefore open from the expansion chamber 5 defined by the valve housing 6 via the valve stem orifice 13*a* to the delivery port 14. The limiting open position of the valve poppet 8 is fixed by the wall 6*b* of housing 6, the valve poppet 8 encountering the housing wall, and stopped there. The valve stem orifice 13*a* when in the open position communicates the stem passage 13 over the sharp edge 13*b* with the actuator passages 16, 17 and valve delivery port 14, and thus depressing the actuator 12 permits fluid flow via the chamber 5 to be dispensed from the container at delivery port 14.

Thus, the spring 18 ensures that the valve poppet 8 and therefore valve 4 is normally in a closed position, and that the valve is open only when the button actuator 12 is moved manually against the force of the spring 18.

The valve housing 6 has an expanded portion 6*a* within which is received the sealing gasket 9 and retained in position at the upper end of the housing. The expanded portion 6*a* is retained by the crimp 23*b* in the center of the mounting cup 23, with the valve stem 11 extending through an aperture 23*a* in the cup. The cup 23 is attached to the container dome 24, which in turn is attached to the main container portion 25.

The expansion chamber 5 of the valve housing 6 terminates in a passage 5*a*, enclosed in the tail piece 6*c* of the housing 6. In the lower portion of the passage 5*a* is inserted one end of the capillary dip tube 32, which extends all the way to the bottom of the container, and thus dips into the liquid phase of the aerosol composition in portion 21 of the container. Beyond the outlet of the dip tube 32 in passage 5*a* is a constricted passage 33, with a sharp-edged inlet 33*a*, constituting the first flow constriction in this valve system, and the expansion chamber 5 of the valve housing 6 serves as the expansion chamber for this constricted passage. The valve stem passage 13 serves as the expansion chamber for the second flow constriction, the valve stem orifice 13*a*. A mixing chamber 35 is defined in the tail piece 6*c* between the constricted passage 33 and the capillary dip tube passage 36.

A vapor tap orifice 2 extends through the wall of the tail piece 6*c* in flow connection with the upper portion 20 of the space 21 within the container 1, and therefore with the gas phase of propellant, which rises into this portion of the container.

Liquid aerosol composition accordingly enters the chamber 35 via the capillary dip tube passage 36, so that the dip tube serves as a long liquid tap orifice, while gas enters the chamber 35 through the gas tap orifice 2.

In the valve shown, all orifices are circular in cross-section, and the diameter of the actuator (valve delivery) orifice 14 is 0.38 mm; the diameter of the valve stem orifice 13*a* is 0.40 mm; the diameter of the valve stem passage is 1.0 mm; the diameter of the vapor tap orifices 2 is 0.88 mm, and the inside diameter of the capillary dip tube 32 is 1.5 mm. The diameter of the constricted passage 33 is 0.40 mm, and the diameter of expansion chamber 5 is 7.5 mm.

In operation, button 12 is depressed, so that the valve stem 11 and with it valve poppet 8 and orifice 13*a* are manipulated to the open position, away from valve seat 19. Liquid aerosol composition is thereupon drawn up via the capillary dip tube 32 and passage 36 into the mixing chamber 35, while propellant gas passes through the vapor tap orifice 2, and is blended with the liquid aerosol composition in the chamber 35.

After thorough mixing in chamber 35, the gas liquid mixture passes through the first constricted passage 36 into the expansion chamber 5 in the valve housing, now at a higher gas:liquid volume ratio, and flows up around the poppet 8 towards the valve stem orifice 13*a*. It then passes through the second constricted passage, valve stem orifice 13*a*, and then into the second expansion chamber, the valve stem passage 13, and then via passages 16, 17 to the delivery port 14.

By the time the mixture reaches the port 14, the gas:-liquid volume ratio has increased to within the nonflammable portion of the range. Accordingly, a flammability hazard due to the escape of flammable liquid is avoided.

Figure 3:
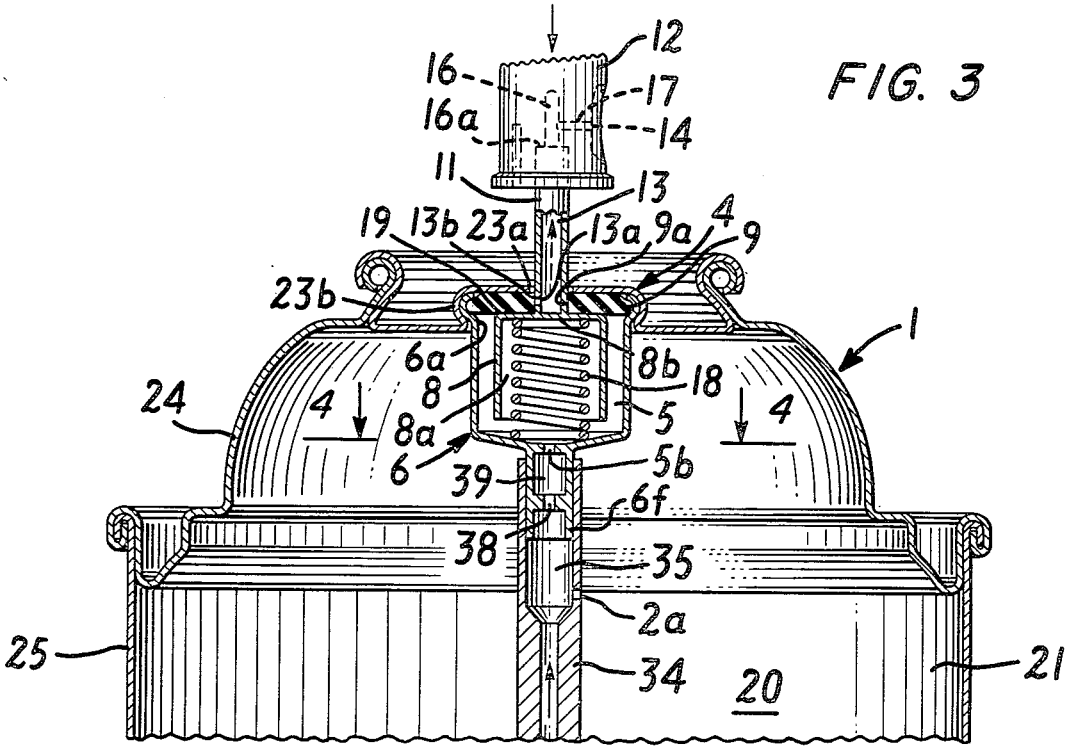
FIG. 3 represents a fragmentary longitudinal sectional view of another embodiment of valve system in accordance with the invention, with a vapor tap orifice and a capillary dip tube in fluid flow connection with the mixing chamber, and two flow constrictions in the tail piece downstream of the mixing chamber, and the third flow constriction the valve stem orifice.
Figure 4:
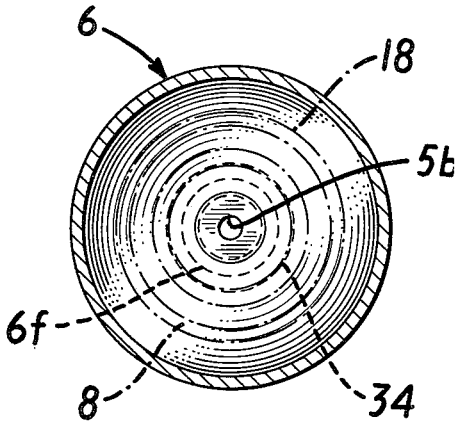
FIG. 4 represents a cross-sectional view taken along the line 4—4 of FIG. 3.

In the aerosol container shown in FIGS. 3 and 4, there are two sharp-edged constricted passages in the tail piece, one near the center of the tail piece and an additional constriction interposed in the tail piece at the entrance to the valve housing, and the valve stem orifice serves as a third flow restriction. These give the desired decrease in gas pressure and increase in gas/liquid volume ratio during flow towards the valve delivery system of the container when the valve is opened. In other respects, the container and the valve are identical to that of FIGS. 1 and 2, and therefore like reference numerals are used for like parts.

In this container, the aerosol valve is of conventional type except for the tail piece modification, as shown in FIGS. 3 and 4, with a valve stem 11 having a valve button 12 attached at one end, with valve button passages 16, 17 and a delivery port 14 therethrough, and a valve body 6 pinched by crimp 23*b* in the aerosol container cap 23. The valve body 6 has an expansion chamber 5, which opens at the end into the restricted tail piece orifice 5*b*, constituting a second constricted passage, and at the other end, beyond the valve poppet 8, when the valve is open, into the valve stem orifice 13*a*, which constitutes a third constricted passage. The first constricted passage 38 is in the tail piece just upstream of the restricted tail piece orifice 5*b*, with an expansion chamber 39 therebetween. The mixing chamber 35 in the tail piece communicates via passage 36 with liquid aerosol composition stored in the lower portion 21 of the container; and the capillary dip tube 34 extends from the tail piece 6*f*, in which it is press-fitted in place, to the bottom of the container.

The valve poppet 8 is reciprocably mounted at one end of the valve stem 11, and is biased by the spring 18 against the valve seat 19 on the inside face of gasket 9 in the normally closed position. The valve is opened by depressing the button actuator 12. When the valve poppet 8 is away from its seat, the valve stem orifice 13*a* is in fluid flow communication with the expansion chamber 5, and the constricted passages and mixing chamber upstream.

The tail piece at the mixing chamber 35 is provided with a vapor tap orifice 2*a*, which puts the chamber 5 in flow connection with the gas or propellant phase in the space 20 at the upper portion of the aerosol container.

In this aerosol container, all orifices and passages are circular in cross-section, and the diameter of the actuator (valve delivery) orifice 14 is 0.38 mm; the diameter of the valve stem orifice 13*a* is 0.50 mm; the diameter of the valve stem passage is 1.0 mm; the diameter of the vapor tap orifice 2*a* is 0.75 mm; the inside diameter of the capillary dip tube is 1.5 mm; the diameter of the second tail piece constricted passage 5*b* is 0.50 mm; the diameter of the first constricted passage 38 is 0.50 mm; the diameter of the expansion chamber 39 is 2.5 mm; and the diameter of the expansion chamber 5 is 7.5 mm.

In operation, the button 12 is depressed, so that the valve poppet 8 and valve stem orifice 13*a* are manipulated to the open position. Liquid aerosol composition is drawn up by the capillary dip tube 34 and passage 37 into the mixing chamber 35 where it is blended with propellant gas entering the chamber 35 via the vapor tap orifice 2*a* from the propellant space 21 of the container. The mixture is expelled under propellant gas pressure through the constricted passage 38 into the expansion chamber 39, where the gas pressure is reduced and the gas:liquid volume ratio is increased; then through the restricted tail piece orifice passage 5*b* into the expansion chamber 5 where the gas:liquid volume ratio is again increased; and then through the valve stem orifice 13*a*, and via the valve stem passage 13, where the gas:liquid ratio is again increased, to within the nonflammable limits of this ratio, and finally via button passages 16, 17, leaving the container at delivery port 14 of the valve as a fine spray which is flameless. Accordingly, a flammability hazard due to the escape of flammable liquid is avoided.

Figure 5:
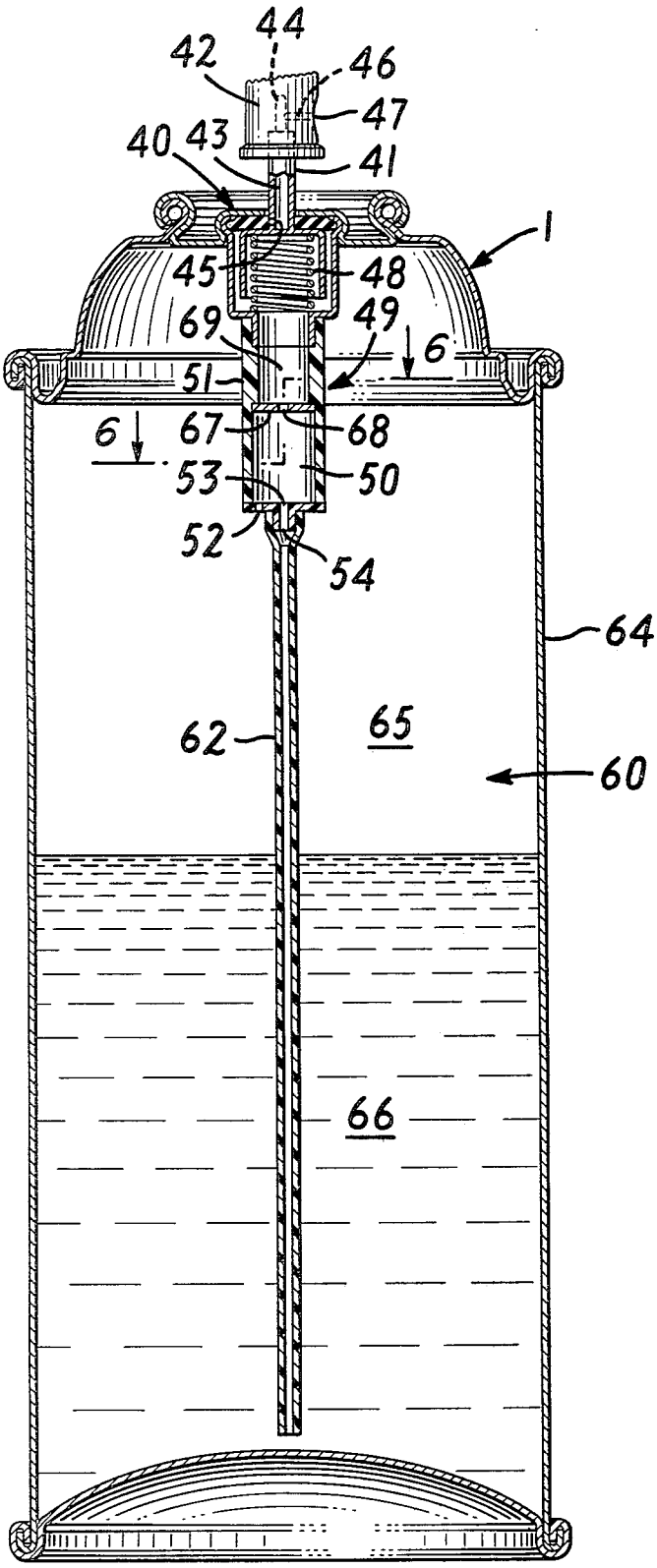
FIG. 5 represents a longitudinal sectional view of another embodiment of aerosol container in accordance with the invention, with one flow constriction in the valve housing, at the outlet end of the mixing chamber, and the other flow constriction the valve stem orifice.
Figure 6:
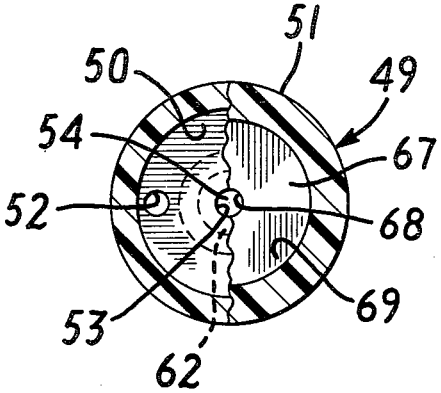
FIG. 6 represents a cross-sectional view taken along the line 6—6 of FIG. 5.

In the aerosol container shown in FIGS. 5 and 6, the aerosol delivery valve 40 is of conventional type, with a valve stem 41 having a valve button 42 attached at one end and a valve stem passage 43 therethrough, in flow communication at one end via valve stem orifice 45 with the interior of an expansion chamber 69 and mixing chamber 50 in the valve housing 49, defined by side and bottom walls 51, with a gas tap orifice 52 and a liquid tap orifice 54 which is a capillary dip tube therein.

Extending all the way across the downstream end of mixing chamber 50 is a wall 67 with a constricted passage 68 therethrough and an expansion chamber 69 between the wall 67 and the valve stem orifice 45. These constitute the first flow constriction and expansion chamber. The valve stem orifice 45 and valve stem passage 43 constitute the second flow constriction and the second expansion chamber.

The orifices and passages are all circular in cross-section, and orifice 52 is 0.5 mm in diameter, and orifice 54 is 0.75 mm in diameter, the same as the inside diameter of the capillary dip tube. In this aerosol container, the diameter of the actuator (valve delivery) orifice 14 is 0.45 mm; the diameter of the valve stem orifice 13*a* is 0.50 mm; the diameter of the valve stem passage is 1.0 mm; the diameter of the first constricted passage 68 is 0.50 mm; the diameter of the expansion chamber 69 is 0.35 mm.

Both orifices 52, 54 are in flow communication with the storage compartment 60 of the container, defined by walls 51 and the outer container wall 64. The valve stem passage 43 is open at the outer end at port 44 via button passage 46 to delivery port 47. The valve button 42 is manually moved against the coil spring 48 between open and closed positions. In the closed position, shown in FIG. 5, the valve port 45 is closed, the valve being seated against the valve seat. In the open position, the valve stem is depressed by pushing in button 42, so that port 45 is exposed, and the contents of the mixing chamber are free to pass through the valve passage 43 and button passage 46 out the delivery port 47.

The storage compartment 60 contains liquefied propellant (such as a flammable hydrocarbon, with a gas layer above, that fills headspace 65) as part of the liquid layer 66 of aerosol composition. A capillary dip tube 62 extends from the inlet 53 in mixing chamber 50 to the bottom of the propellant compartment 60. Through it, liquid aerosol composition enters the mixing chamber at orifice 54, while propellant gas enters at orifice 52, when the valve 40 is opened.

In operation, button 42 is depressed, so that the delivery valve is manipulated to the open position. Liquid aerosol composition is drawn up via capillary dip tube 62 and orifice 54 into mixing chamber 50, while propellant gas passes through the orifice 52 and mixes with the aerosol composition in the compartment 50, where it expels the aerosol composition through the constricted passage 68, expansion chamber 69, the valve stem orifice 45, valve stem passage 43 and button passage 46 to the delivery port 47, were it leaves the valve as a fine spray that is flameless. The two constricted passages and expansion chambers en route increase the gas: liquid volume ratio to within the nonflammable portion of the range.

The aerosol container and valve system of the instant invention can be used to deliver any aerosol composition of the solution-type or of the dispersion-type containing flammable ingredients, such as propellants and solvents in the form of a spray. However, the container and valve system is better adapted for use with the solution-type liquid aerosol compositions when the flow constrictions have small open areas, where dispersion-types containing suspended solid materials can give rise to clogging problems. With large enough flow constrictions, the container can be used for any liquid aerosol composition. The range of products that can be dispensed by this aerosol container is diverse, and includes pharmaceuticals for spraying directly into oral, nasal and vaginal passages; antiperspirants; deodorants; hair sprays, fragrances and flavors; body oils; insecticides; window cleaners and other cleaners; spray starches; and polishes for autos, furniture and shoes.

The following Examples in the opinion of the inventors represent preferred embodiments of the invention.

In the Examples the flame extension of each system was determined by spraying the sample at a distance of six inches into the upper one-third of a candle flame and the flame extension measured using a calibrated stationary scale (page 40 of the I.C.C. Tariff 10 from the Chemical Specialties Manufacturers Association, Inc.

Agencies and Regulations, Aug. 19, 1958). A flame extension of over eighteen inches is considered flammable.

CONTROLS A to D

To determine the effect of flow constrictions on liquid flow rate in the absence of gas, a group of aerosol containers with a variety of valve systems, none of which had a vapor tap, and with one or two flow constrictions, and 0.060 inch, 1.5 mm, 7 cm long capillary dip tubes were filled with water, and pressurized with liquefied isobutane propellant under a pressure of 46 psia. All orifices and passages were circular in cross-section. Since none of the valves had a vapor tap, these Examples do not illustrate the invention.

The following nozzles were used:

TABLE I

| | |
|---|---|
| RKN-78 | Two-piece mechanical break-up 0.015 inch, 0.38 mm orifice, 0.011 inch, 0.28 mm land (orifice length) |
| RKN-115 | Two-piece, nonmechanical break-up, double orifices 0.018 inch, 0.45 mm outside, 0.017 inch, 0.43 mm internal |
| RKN-79 | Two piece, nonmechanical break-up 0.018 inch, 0.45 mm orifice |
| RKN-49 | One piece, 0.018 inch, 0.45 mm orifice, reverse taper |

The spray rates in cc/sec were determined by spraying for five seconds, and determining loss in weight, with the 15 following results:

TABLE II

| | Flow Constriction Diameter | | | Spray Rate (cc/sec) | | | |
|---|---|---|---|---|---|---|---|
| Example No. | Inch | mm | Location | RKN-78 | RKN-115 | RKN-79 | RKN-49 |
| Control 1 | 0.012 | 0.30 | Valve stem orifice | 1.26 | 1.58 | 1.70 | 1.72 |
| Control 2 | 0.016 | 0.40 | Valve stem orifice | 1.44 | 2.02 | 2.60 | 2.52 |
| Control 3 | 0.020 | 0.50 | Valve stem orifice | 1.74 | 2.30 | 2.66 | 2.86 |
| A(1) | 0.016 | 0.40 | Tail piece orifice | 1.26 | 1.42 | 1.40 | 1.52 |
| (2) | 0.016 | 0.40 | Valve stem orifice | | | | |
| B(1) | 0.020 | 0.50 | Tail piece orifice | 1.38 | 1.98 | 2.60 | 2.50 |
| (2) | 0.020 | 0.50 | Valve stem orifice | | | | |
| C(1) | 0.020 | Capillary[1] | Tail piece orifice | 1.44 | 1.90 | 2.16 | 2.46 |
| (2) | 0.020 | | Valve stem orifice | | | | |

[1]Capillary is 0.3 inch, 7.5 mm length

The data show that the flow constrictions are of sufficiently small sizes to restrict liquid flow; two constrictions give smaller liquid spray rates than one constriction of the same diameter. Further, a 0.75 mm length of capillary dip tube restricts liquid flow to about the same extent as an orifice of the same diameter.

The data show also that it is possible to obtain the same liquid spray rate with two flow constrictions in accordance with the invention as with one by adjusting the orifice open areas. Thus, for actuator RKN-78, Control 1 matches Control A in spray rate, and Control 2 matches Control C.

A fill of 50% ethanol/50% isobutane was substituted (density 0.64 g/cc), in the same containers. The spray rates were as follows:

TABLE III

| | Flow Constriction Diameter | | | Spray Rate (cc/sec) | | | |
|---|---|---|---|---|---|---|---|
| Example No. | Inch | mm | Location | RKN-78 | RKN-115 | RKN-79 | RKN-49 |
| Control 1 | 0.012 | 0.30 | Valve stem orifice | 0.94 | 1.06 | 1.16 | 1.19 |
| Control 2 | 0.016 | 0.40 | Valve stem orifice | 1.19 | 1.25 | 1.75 | 1.69 |
| Control 3 | 0.020 | 0.50 | Valve stem orifice | 1.16 | 1.47 | 1.94 | 2.22 |
| A(1) | 0.016 | 0.40 | Tail piece orifice | 0.81 | 0.91 | 1.06 | 1.13 |
| (2) | 0.016 | 0.40 | Valve stem orifice | | | | |
| B(1) | 0.020 cap[1] | 0.50 | Tail piece orifice | 0.94 | 0.97 | 1.03 | 1.02 |
| (2) | 0.016 | 0.40 | Valve stem orifice | | | | |
| C(1) | 0.020 | 0.50 | Tail piece orifice | 1.06 | 1.16 | 1.41 | 1.44 |
| (2) | 0.020 | 0.50 | Valve stem orifice | | | | |
| D(1) | 0.020 cap[1] | 0.50 | Tail piece orifice | 0.88 | 1.06 | 1.25 | 1.31 |
| (2) | 0.020 | 0.50 | Valve stem orifice | | | | |

[1]Capillary is 0.3 inch, 7.5 mm length

With Control valves 1, 2 and 3, which have a single constriction, volumetric spray rates averaged only 70% of the spray rates obtained with water, as shown in Table II, while the spray rates averaged only 63% of the water spray rates with the experimental valves which have a double constriction. These reduced spray rates suggest that the constrictions impose a pressure drop, which results in volatilization of a portion of the isobutane present in the liquid composition that is being expelled.

Again, the data show that it is possible to match spray rates with two flow restrictions. For actuator RKN-78, Conrol B matches Control 1, for example.

EXAMPLES 1 to 5

A group of aerosol containers were fitted with vapor tap valves having a 0.030 or 0.035 inch (0.75 or 0.088 mm) diameter vapor tap and a 0.060 inch, 0.15 mm inside diameter, 7 cm length of capillary dip tube, and the nozzles shown in Table I above, filled with 150 g of water and pressurized with 3.5 g of an 80% isobutane/20% propane mixture by weight. The gas:liquid volume ratio of the spray at the delivery port was determined by spraying until propellant was exhausted. The propellant was expelled only through the vapor tap, and the amount expelled is equal to that added, corrected for the increase in head space. Water was expelled only through the liquid tap, and was determined as weight loss.

Gas:liquid volume ratios were calculated for the gas at atmospheric pressure and 21° C. The results are shown in Table IV:

TABLE IV

| Example No. | Flow Constriction Diameter Series 1: 0.035 inch, 0.88mm vapor tap Inch | mm | Location | Gas:liquid volume ratio Gas calculated at atmospheric pressure RKN-78 | RKN-115 |
|---|---|---|---|---|---|
| Control E | 0.012 | 0.30 | Valve stem orifice | 163: | 87:1 |
| Control F | 0.016 | 0.40 | Valve stem orifice | 78:1 | 65:1 |
| Control G | 0.020 | 0.50 | Valve stem orifice | 77:1 | 64:1 |
| 1(1) | 0.016 | 0.40 | Tail piece orifice | 60:1 | 38:1 |
| (2) | 0.016 | 0.40 | Valve stem orifice | | |
| 2(1) | 0.020 cap[1] | 0.50 | Tail piece orifice | 61:1 | 59:1 |
| (2) | 0.020 | 0.50 | Valve stem orifice | | |
| 3(1) | 0.020 | 0.50 | Tail piece orifice | 77:1 | 55:1 |
| (2) | 0.020 cap[1] | 0.50 | Second tail piece orifice | | |
| (3) | 0.016 | 0.40 | Valve stem orifice | | |

| Example No. | Flow Constriction Diameter Series 2: 0.030 inch, 0.75mm vapor tap Inch | mm | Location | Gas:liquid volume ratio Gas calculated at atmospheric pressure RKN-78 | RKN-115 |
|---|---|---|---|---|---|
| Control H | 0.012 | 0.30 | Valve stem orifice | 60:1 | 49:1 |
| Control I | 0.016 | 0.40 | Valve stem orifice | 40:1 | 33:1 |
| Control J | 0.020 | 0.50 | Valve stem orifice | 37:1 | 31:1 |
| 4(1) | 0.016 | 0.40 | Tail piece orifice | 23:1 | 15:1 |
| (2) | 0.016 | 0.40 | Valve stem orifice | | |
| 5(1) | 0.020 cap[1] | 0.50 | Tail piece orifice | 17:1 | 19:1 |
| (2) | 0.020 | 0.50 | Valve stem orifice | | |

[1]Capillary is 0.3 inch, 7.5 mm length

Reducing the size of the flow constriction has the effect of increasing the gas:liquid ratio, thereby increasing the proportion of the propellant that is expelled in gaseous form. The consequence is that the smaller the flow constriction the more the gas:liquid ratio changes, and this changes the proportion of propellant remaining during exhaustion. If the flow constriction is too small, all of the propellant may be expelled before the container has completely emptied.

Increasing the number of flow constrictions has the effect of reducing the gas:liquid ratio. Less of the propellant is expelled in gaseous form, and there is less likelihood of incomplete exhaustion of propellant, if two flow constrictions are used in place of one flow constriction of the same size.

Further, increasing the ratio of liquid tap orifice:vapor tap orifice size substantially reduces the gas:liquid ratio. To the extent that the liquid:vapor tap orifice size ratio can be increased while obtaining a spray of low flammability, a more uniform delivery can be maintained, and less propellant will be required for complete exhaustion.

EXAMPLES 6 to 9

A group of aerosol containers were fitted with various vapor tap valves having the nozzles shown in Table I above, and 7 cm capillary dip tubes, filled with 150 g water, pressurized with 3.5 g isobutane, and the gas:liquid volume ratios determined. The results obtained are given in Table V.

TABLE V

| Example No. | Diameter, mm Vapor tap | Capillary dip tube | Flow Constriction Diameter Inch | mm | Location | Gas:liquid volume ratio Gas calculated at atmospheric pressure RKN-78 | RKN-115 |
|---|---|---|---|---|---|---|---|
| Control K | 0.75 | 1.25 | 0.020 | 0.50 | Valve stem orifice | 53:1 | 46:1 |
| Control L | 0.75 | 1.00 | 0.020 | 0.50 | Valve stem orifice | 109:1 | 86:1 |
| Control M | 0.50 | 0.75 | 0.020 | 0.50 | Valve stem orifice | 87:1 | 71:1 |
| 6(1) | 0.75 | 1.25 | 0.020 cap[1] | 0.50 | Tail piece orifice | 54:1 | 40:1 |
| (2) | | | 0.020 | 0.50 | Valve stem orifice | | |
| 7(1) | 0.75 | 1.25 | 0.020 | 0.50 | Tail piece orifice | 46:1 | 34:1 |
| (2) | | | 0.020 cap[1] | 0.50 | Second tail piece orifice | | |
| (3) | | | 0.020 | 0.50 | Valve stem orifice | | |
| 8(1) | 0.75 | 1.00 | 0.020 cap[1] | 0.50 | Tail piece orifice | 68:1 | 57:1 |
| (2) | | | 0.020 | 0.50 | Valve stem orifice | | |
| 9(1) | 0.50 | 0.75 | 0.020 cap[1] | 0.50 | Tail piece orifice | 65:1 | 41:1 |
| (2) | | | 0.020 | 0.50 | Valve stem orifice | | |

[1]Capillary is 0.3 inch, 7.5 mm length

The data show that increasing the liquid:vapor tap open area ratio reduces the gas:liquid ratio. For a given open area ratio, increasing the number of flow constrictions reduces the gas:liquid ratio.

EXAMPLES 10 to 15

A group of aerosol containers were fitted with vapor tap valves having 0.035 inch, 0.88 mm vapor taps, the nozzles shown in Table I above, and 0.060 inch, 1.5 mm, 7 cm length capillary dip tubes, filled with 50% ethanol, 40% isobutane and 10% propane, and the flame extension and spray rates determined. The results obtained are given in Table VI.

TABLE VI

| Example No. | 0.035 inch, 0.88 mm vapor tap Flow Constriction Inch | mm | Location | RKN-78 Flame extension (inches) Upright | Inverted | Spray Rate g/sec | RKN-115 Flame extension (inches) Upright | Inverted | Spray Rate g/sec | RKN-79 Flame extension (inches) Upright | Inverted | Spray Rate g/sec |
|---|---|---|---|---|---|---|---|---|---|---|---|---|
| Control N | 0.012 | 0.30 | Valve stem orifice | 0 | 10 | 0.26 | 0 | 12 | 0.30 | 6 | 12 | 0.30 |
| 10(1) | 0.016 | 0.40 | Tail piece orifice | 0 | 0 | 0.38 | 0 | 0 | 0.45 | 6–9 | 0 | 0.48 |
| (2) | 0.016 | 0.40 | Valve stem orifice | | | | | | | | | |
| 11(1) | 0.020 | 0.40 | Tail piece orifice | 0 | 0 | 0.40 | 6 | 0 | 0.46 | 9 | 0 | 0.60 |
| (2) | 0.016 | 0.50 | Valve stem orifice | | | | | | | | | |
| 12(1) | 0.020 | 0.50 | Tail piece orifice | 0 | 0 | 0.26 | 0 | 0 | 0.30 | 0 | 0 | 0.34 |
| (2) | 0.020 cap[1] | 0.50 | Second tail piece orifice | | | | | | | | | |
| (3) | 0.016 | 0.40 | Valve stem orifice | | | | | | | | | |

[1]Capillary is 0.3 inch, 7.5 mm length

The experiment was repeated with a composition comprising 50% ethanol, 42.5% isobutane and 7.5% propane, a 0.030 inch, 0.75 mm vapor tap, and a 12 cm length, 0.060 inch, 1.5 mm capillary dip tube. All compositions are in percent by weight The results are given in Table VII.

TABLE VII

| Example No. | 0.030 inch, 0.75 mm vapor tap Flow Constriction Inch | mm | Location | RKN-115 Flame extension (inches) Upright | Inverted | Spray rate (g/sec) |
|---|---|---|---|---|---|---|
| Control O | 0.016 | 0.40 | Valve stem orifice | >12 | 6–8 | 0.50 |
| 13 (1) | 0.020 cap[1] | 0.50 | Tail piece orifice | 0 | 0 | 0.50 |
| (2) | 0.016 | 0.40 | Valve stem orifice | | | |
| 14 (1) | 0.020 | 0.50 | Tail piece orifice | 6[2] | 0 | 0.48 |
| (2) | 0.020 cap[1] | 0.50 | Second tail piece orifice | | | |
| (3) | 0.020 | 0.50 | Valve stem orifice | | | |
| 15 (1) | 0.020 | 0.50 | Tail piece orifice | 6 | 0 | 0.48 |
| (2) | 0.020 | 0.50 | Valve stem orifice | | | |

[1]Capillary is 0.3 inch, 7.5 mm length
[2]Weak thin flame extension

Tables VI and VII clearly show that very low flame extensions are even zero flame extensions are obtained, in both upright and inverted positions of the container, by using two or more flow constrictions. Table VI shows that with the RKN-79 actuator, the use of three flow constrictions results in zero flame extensions in both upright and inverted positions of the container. In constrast, the control valves with only one flow constriction gave substantial flame extensions in either the upright or inverted position of the container.

EXAMPLES 16 to 27

A group of a aerosol containers were fitted with vapor tap valves having 0.030 or 0.035 inch vapor taps, the nozzles shown in Table I above, and 0.060 inch, 1.5 mm, 12 cm capillary dip tubes, filled with a composition comprising 65% isopropanol, 28% isobutane, and 7% propane, all by weight, and the flame extension and spray rates determined. The results are given in Table VIII.

TABLE VIII

| Example No. | Flow constriction Inch | mm | Location | RKN-78 Upright | Inverted | Spray rate (g/sec) | RKN-115 Upright | Inverted | Spray rate (g/sec) |
|---|---|---|---|---|---|---|---|---|---|
| Series 1: 0.035 inch 0.88 mm vapor tap | | | | | | | | | |
| Control P | 0.016 | 0.40 | Valve stem orifice | 0 | >12 | 0.32 | 0–8 | >12 | 0.32 |
| Control Q | 0.020 | 0.50 | Valve stem orifice | 0–6 | >12 | 0.34 | >12 | >12 | 0.36 |
| 16 (1) | 0.020 | 0.50 | Tail piece orifice | 0 | 0 | 0.34 | 0–6 | 6 | 0.48 |
| (2) | 0.020 | 0.50 | Valve stem orifice | | | | | | |
| 17 (1) | 0.020 cap[1] | 0.50 | Tail piece orifice | 0 | 0 | 0.38 | 8 | 6 | 0.44 |
| (2) | 0.020 | 0.50 | Valve stem orifice | | | | | | |
| Series 2: 0.030 inch 0.75 mm vapor tap | | | | | | | | | |
| Control R | 0.016 | 0.40 | Valve stem orifice | >12 | 6 | 0.44 | | | |
| Control S | 0.020 | 0.50 | Valve stem orifice | >12 | 0 | 0.56 | | | |
| 18 (1) | 0.020 | 0.50 | Tail piece orifice | 6 | 0 | 0.40 | | | |
| (2) | 0.020 | 0.50 | Valve stem orifice | | | | | | |
| 19 (1) | 0.025 | 0.63 | Tail piece orifice | 0 | 0 | 0.36 | | | |
| (2) | 0.025 | 0.63 | Second tail piece | | | | | | |

TABLE VIII-continued

| Flow constriction Series 1: 0.035 inch 0.88 mm vapor tap | | | | RKN-78 | | | RKN-115 | | |
|---|---|---|---|---|---|---|---|---|---|
| Example No. | Inch | mm | Location | Upright | Inverted | Spray rate (g/sec) | Upright | Inverted | Spray rate (g/sec) |
| | | | orifice | | | | | | |
| (3) | 0.020 | 0.50 | Valve stem orifice | | | | | | |

[1]Capillary is 0.3 inch, 7.5 mm length

The data of Table VIII show that the control valves with only one flow constriction give substantial flame extensions in at least the upright or inverted position of the container. With two or more flow constrictions, much reduced flame extensions are obtained in both positions of the container.

EXAMPLES 20 to 22

A group of aerosol containers were fitted with vapor tap valves having 0.020 to 0.030 inch vapor taps, the nozzle shown in Table I above, and 0.030, 0.040, and 0.050 inch (0.75, 1.00, and 1.25 mm, respectively), 12 cm capillary dip tubes, filled with a composition comprising 68% isopropanol, 30% isobutane, and 5% propane, all by weight, and the flame extension and spray rates determined. The results are shown in Table IX.

TABLE IX

| Example No. | Diameter mm Vapor tap | Capillary dip tube[1] | Flow constriction Diameter Inch | mm | Location | RKN-78 Flame extension (inches) Upright | Inverted | Spray rate (g/sec) | RKN-115 Flame extension (inches) Upright | Inverted | Spray rate (g/sec) |
|---|---|---|---|---|---|---|---|---|---|---|---|
| Control T | 0.75 | 1.25 | 0.020 | 0.50 | Valve stem orifice | >12 | 10 | 0.36 | >12 | >12 | 0.44 |
| Control U | 0.75 | 1.00 | 0.020 | 0.50 | Valve stem orifice | 0 | 12 | 0.28 | 6 | >12 | 0.30 |
| Control V | 0.50 | 0.75 | 0.020 | 0.50 | Valve stem orifice | 0 | 10–12 | 0.32 | 6 | >12 | 0.42 |
| 20(1) | 0.75 | 1.25 | 0.020 cap[1] | 0.50 | Tail piece orifice | 0 | 0 | 0.36 | 0 | 0 | 0.36 |
| (2) | | | 0.020 | 0.50 | Valve stem orifice | | | | | | |
| 21(1) | 0.75 | 1.00 | 0.020 cap[1] | 0.50 | Tail piece orifice | 0 | 0 | 0.32 | 0 | 6 | 0.36 |
| (2) | | | 0.020 | 0.50 | Valve stem orifice | | | | | | |
| 22(1) | 0.50 | 0.75 | 0.020 cap[1] | 0.50 | Tail piece orifice | 0 | 0 | 0.36 | 6 | 6 | 0.40 |
| (2) | | | 0.020 | 0.50 | Valve stem orifice | | | | | | |

[1]Capillary is 0.3 inch, 7.5 mm length

The data of Table IX show that the control valves with only one flow restriction gave substantial flame extensions in at least one position of the container. With two flow constrictions, reduced flame extensions, including zero values, were obtained with the container upright and inverted.

EXAMPLE 23

Two aerosol containers having the structure shown in FIGS. 1 and 2 were filled with an aerosol composition containing equal parts by weight of absolute ethyl alcohol and liquefied isobutane hydrocarbon propellant at 46 psi. The vapor tap valve had a 0.029 inch diameter vapor tap and a 0.060 inch diameter capillary dip tube, with an RKN-115 actuator, actuator orifice as shown in Table I. One container was fitted with two sharp-edged orifices 33*a*, 13*a*, each having a diameter of 0.016 inch. The other container was fitted with two orifices, one of whose upstream edges as well rounded; otherwise, the containers were identical.

The container having the rounded orifice edge gave a 6 to 8 inch flame projection upright, while the container having the sharp-edged orifices gave a zero flame projection. The container with the rounded orifice inlet gave a wetter spray than the container with the sharp-edged orifice inlets.

This shows the significance of the sharp-edged inlet for the constricted passage, in increasing gas/liquid ratio.

Having regard to the foregoing disclosure, the following is claimed as the inventive and patentable embodiments thereof:

1. An aerosol container for use with compositions containing liquefied flammable propellants, and having a delivery valve that delivers a spray that in either flameless or at worst has an abnormally low flame extension, whether the container is in an upright position or in a fully inverted position, comprising, in combination, a pressurizable container having at least one storage compartment for a liquefied aerosol composition and a liquefied propellant; a delivery valve movable manually between open and closed positions, and including a valve stem, a valve stem passage, a valve stem orifice at the beginning of the valve stem passage, and a delivery port; a mixing chamber having at least one liquid tap orifice and at least one vapor tap orifice in flow connection with the storage compartment for reception therefrom and mixing together in the chamber liquid aerosol composition and gaseous propellant, respectively; an aerosol-conveying passage in flow connection at one end with the mixing chamber and at the other end with the valve stem orifice, manipulation of the delivery valve opening and closing the passage to flow of liquid aerosol composition and gaseous propellant from the storage compartment to the mixing chamber and delivery port; and at least two flow constrictions disposed across the passage in the line of flow from the mixing chamber to the valve stem orifice, each constriction having an open area within the range from about 0.05 to about 0.4 $mm^2$, and at least two expansion chambers, one following each constriction, each having a diameter of at least 25% greater than that of the preceding constriction, thereby increasing the gas:liquid volume ratio in the mixture leaving the delivery port and reducing the flammability of the delivered spray.

2. An aerosol container and valve system according to claim 1 in which at least one of the flow constrictions is an orifice.

3. An aerosol container and valve system according to claim 2 in which the container includes a tail piece and tail piece passage therethrough in the line of flow from the storage compartment and the liquid tap orifice and one of the said flow constrictions and the mixing chamber are in the tail piece passage, and another of said flow constrictions is the valve stem orifice, and the valve stem passage is the expansion chamber for that flow constriction.

4. An aerosol container and valve system according to claim 3 in which a third flow constriction and expansion chamber are interposed between the mixing chamber and the valve stem orifice.

5. An aerosol container and valve system according to claim 4 in which the delivery valve comprises a valve housing and the third flow constriction and expansion chamber are interposed in the valve housing.

6. An aerosol container and valve system according to claim 1 in which at least one of the said flow constriction passages is a narrow passage having a length less than about 15 mm.

7. An aerosol container and valve system according to claim 6 in which the container includes a tail piece and tail piece passage therethrough in the line of flow from the storage compartment and the liquid tap orifice and one of said flow constrictions and the mixing chamber are in the tail piece passage, and another of said flow constrictions is the valve stem orifice, and the valve stem passage is the expansion chamber for that flow constriction.

8. An aerosol container and valve system according to claim 6 in which a third flow constriction and expansion chamber are interposed between the mixing chamber and the valve stem orifice.

9. An aerosol container and valve system according to claim 8 in which the delivery valve comprises a valve housing and the third flow constriction and expansion chamber are interposed in the valve housing.

10. An aerosol container and valve system according to claim 1 in which at least one of the flow constrictions is a venturi.

11. An aerosol container and valve system according to claim 1 in which the flow restrictions are circular in cross-section.

12. An aerosol container and valve system according to claim 1 in which there are three flow constrictions and three expansion chambers.

13. An aerosol container and valve system according to claim 1 in which the delivery valve comprises a valve member movably disposed in a valve housing; and at least one of the said flow constrictions and expansion chambers are disposed in the valve housing.

14. An aerosol container and valve system according to claim 13 in which the container comprises a tail piece and tail piece passage therethrough in a line of flow from the storage compartment and the valve housing, and another of the said flow constrictions and expansion chambers are disposed in the tail piece passage.

15. An aerosol container and valve system according to claim 13 in which another of the said flow constrictions is the valve stem orifice followed by an expansion chamber in the valve stem passage.

16. An aerosol container and valve system according to claim 13 in which the valve housing includes two flow constrictions and two expansion chambers before the valve stem orifice.

17. An aerosol container and valve system according to claim 1 in which the mixing chamber has a volume within the range from about 0.01 to about 0.5 cc.

18. An aerosol container and valve system according to claim 1 in which the mixing chamber has a liquid tap orifice which communicates the mixing chamber with a capillary dip tube extending into liquid aerosol composition in the storage compartment of the container.

19. An aerosol container and valve system according to claim 18 having a tail piece interposed between the liquid tap orifice and the capillary dip tube with a tail piece passage therethrough, and at least one flow constriction and expansion chamber are disposed in the tail piece.

20. An aerosol container and valve system according to claim 18 in which the flow constrictions are each orifices, the capillary dip tube provides an aggregate cross-sectional open area within the range from about 0.08 to about 3.0 $mm^2$; the vapor tap orifice provides an aggregate cross-sectional open area within the range from about 0.05 to about 0.8 $mm^2$, the ratio of liquid tap orifice to vapor tap orifice cross-sectional open area being within the range from about 1.5:1 to about 4:1; the first flow constriction has a cross-sectional open area within the range from about 0.05 to about 0.4 $mm^2$; and the second flow constriction has a cross-sectional open area within the range from about 0.05 to about 0.4 $mm^2$.

21. An aerosol container and valve system according to claim 18 in which at least one of the flow constrictions is a short capillary passage, the capillary dip tube provides an aggregate cross-sectional open area within the range from about 0.08 to about 3.0 $mm^2$; and the vapor tap orifice provides an aggregate cross-sectional open area within the range from about 0.05 to about 0.8 $mm^2$, the ratio of liquid tap orifice to vapor tap orifice cross-sectional open area being within the range from about 1.5:1 to about 4:1; the short capillary passage constitutes the first flow constriction and has a cross-sectional open area within the range from about 0.05 to about 0.4 $mm^2$; and the second flow constriction has a cross-sectional open area within the range from about 0.05 to about 0.4 $mm^2$.

22. A process for delivering from a delivery port of an aerosol container having a vapor tap valve a spray of abnormally low flammability of liquid aerosol composition containing a flammable liquefied propellant, which comprises turbulently mixing together liquid aerosol composition and gaseous propellant; forming a turbulent flow of the gas/liquid mixture and differentially slowing liquid flow more than gas flow by imposing upon the flow the constraint of a flow constriction having an open area within the range from about 0.05 to about 0.4 $mm^2$; releasing the constraint and permitting the gas/liquid mixture to expand in an expansion chamber whose open area is at least 50% greater than the flow constriction; again differentially slowing liquid flow more than gas flow by imposing upon the flow the constraint of a flow constriction having an open area within the range from about 0.05 to about 0.4 $mm^2$, again releasing the constraint, and permitting the gas/-liquid mixture to expand in an expansion chamber whose open area is at least 50% greater than the flow constriction, and then passing the mixture through the remainder of the vapor tap valve to the delivery port; with each constraint and expansion increasing the gas:-liquid volume ratio of the mixture and delivering at the delivery a spray of abnormally low flammability.

23. A process according to claim 22 which comprises subjecting the gas/liquid mixture to three constraints and three expansions before the valve stem orifice.

* * * * *